US008561452B2

(12) United States Patent
Seeber

(10) Patent No.: US 8,561,452 B2
(45) Date of Patent: Oct. 22, 2013

(54) FORGING APPARATUS

(75) Inventor: Alfred Seeber, Steyr (AT)

(73) Assignee: GFM-GmbH, Steyr (AT)

( * ) Notice: Subject to any disclaimer, the term of this patent is extended or adjusted under 35 U.S.C. 154(b) by 0 days.

(21) Appl. No.: 13/642,935

(22) PCT Filed: Jun. 21, 2011

(86) PCT No.: PCT/AT2011/000271

§ 371 (c)(1),
(2), (4) Date: Oct. 23, 2012

(87) PCT Pub. No.: WO2011/160147

PCT Pub. Date: Dec. 29, 2011

(65) Prior Publication Data

US 2013/0036786 A1 Feb. 14, 2013

(30) Foreign Application Priority Data

Jun. 22, 2010 (AT) ..... 1028/2010

(51) Int. Cl.
*B21D 41/00* (2006.01)

(52) U.S. Cl.
USPC ..... 72/402; 72/404; 72/446; 72/450

(58) Field of Classification Search
USPC ..... 72/402, 404, 446, 450
See application file for complete search history.

(56) References Cited

U.S. PATENT DOCUMENTS 684,216 A * 10/1901 Gardner et al. ..... 72/402
3,222,912 A 12/1965 Specht
3,416,352 A * 12/1968 Ribback ..... 72/402
3,893,327 A 7/1975 Fedorov et al.
4,434,645 A * 3/1984 Svercl et al. ..... 72/402

FOREIGN PATENT DOCUMENTS

| | | |
|---|---|---|
| DE | 1 241 683 | 6/1967 |
| DE | 3 130 342 | 5/1982 |
| FR | 2 415 146 | 8/1979 |

OTHER PUBLICATIONS

International Search Report of PCT/AT2011/000271, date of mailing Dec. 16, 2011.

* cited by examiner

*Primary Examiner* — David B Jones
(74) *Attorney, Agent, or Firm* — Collard & Roe, P.C.

(57) ABSTRACT

A forging apparatus is described, comprising forging tools (5) which are arranged in a centrically symmetrical way about a forging axis (2) and whose tool holders (4) radially guided in a frame (3) are connected with lifting drives (7), which each comprise one respective connecting rod (8) that is pivotably supported via abutments (9) on a housing (1) on the one hand and on the tool holder (4) on the other hand, and comprising a common drive for the lifting drives (7) which comprises a torsional vibration drive (11) for at least one actuator (12) for the one of the two abutments (9, 10) of the connecting rods (8), which actuator is rotatably held about the forging axis (2). In order to ensure advantageous constructional conditions, it is proposed that the frame (3) forms the actuator (12) of the common drive for the lifting drives (7), and that the torsional vibration drive (11) is provided between the housing (1) and the frame (3) which is rotatably held about the forging axis (2).

3 Claims, 4 Drawing Sheets

FORGING APPARATUS

CROSS REFERENCE TO RELATED APPLICATIONS

This application is the National Stage of PCT/AT2011/000271 filed on Jun. 21, 2011, which claims priority under 35 U.S.C. §119 of Austria Application No. A 1028/2010 filed on Jun. 22, 2010, the disclosure of which is incorporated by reference. The international application under PCT article 21(2) was not published in English.

1. Field of the Invention

The invention relates to a forging apparatus, comprising forging tools which are arranged in a centrically symmetrical way about a forging axis and whose tool holders radially guided in a frame are connected with lifting drives, which each comprise one respective connecting rod that is pivotably supported via an abutments on a housing on the one hand and on the tool holder on the other hand, and comprising a common drive for the lifting drives which comprises a torsional vibration drive for at least one actuator for the one of the two abutments of the connecting rods, which actuator is rotatably mounted about the forging axis.

2. Description of the Prior Art

Forging apparatuses with forging tools which are arranged in a rotationally symmetrical way about a forging axis and which are usually diametrically opposite of one another with respect to the forging axis comprise different lifting drives for the forging tools. It is therefore known for example to assign an eccentric shaft drive to each tool holder which is guided in a radially displaceable manner in a frame with respect to the forging axis, with the eccentric shafts being synchronized by way of a common spur gear. The advantage of these eccentric shaft drives, which is the realization of large forging forces in combination with high impact rates, is offset by the disadvantage of a high constructional complexity. If synchronized hydraulic drives are used as lifting drives, a simpler construction is obtained but the achievable impact rates remain limited. A further drive for the tool holders which are guided radially in a frame with respect to the forging axis comprises for each forging tool a cam output with a common drive in form of a cam wheel which is held co-axially to the forging axis and which is driven continuously, so that the actuating cams of the revolving cam wheel will supply the tool holders with a respective working stroke. The difficult lubricating conditions and the forging forces which are limited in their magnitude are disadvantageous.

For the purpose of avoiding these disadvantages, it has already been proposed (DE 1 241 683 B, DE 3130 342 A1) to guide the tool holders in a radially displaceable manner in a frame fixed to the housing and to activate them with lifting drives which respectively comprise a connecting rod, which is linked on the one hand to the tool holder and on the other hand to a common live ring which encloses the frame, is co-axial to the forging axis and is driven in a torsionally vibrating manner by means of a crank mechanism which is provided outside of the housing, so that the tool holders can be radially displaced due to the resulting pivoting displacement of the connecting rods. It is especially disadvantageous in these known constructions that the forging forces are removed via the connecting rods to the live ring, which therefore needs to be arranged in an especially deflection-resistant way when low forging tolerances need to be observed. A deflection-resistant live ring belongs to the moved masses however, which has a disadvantageous effect on the drive and the lifting frequency of the tool holder. Moreover, an externally disposed live ring has a negative effect on a compact configuration of such forging apparatuses.

SUMMARY OF THE INVENTION

The invention is therefore based on the object of providing a forging apparatus of the kind mentioned above in such a way that large forging forces can be provided in combination with high impact rates, which is achieved with comparatively simple constructional means.

This object is achieved by the invention in such a way that the frame forms the actuator of the common drive for the lifting drives and that the torsional vibration drive is provided between the housing and the frame which is rotatably held about the forging axis.

As a result of the rotatable bearing of the frame forming the radial guide for the tool holders in the housing and the torsionally vibrating drive of said frame, the radial forging forces are introduced directly into the housing via the connecting rods, which housing needs to be provided with a sufficiently stiff configuration in any case, so that a compact construction is obtained which is advantageous for absorbing large forging forces and which offers the advantage of high forging precision. The masses to be driven in a torsionally vibrating manner remain substantially small due to the possible diametrical limitation of the frame and its loading substantially only in the circumferential direction in order to ensure high impact rates in combination with economical driving. Furthermore, preconditions for a closed-type design are advantageously provided as a result of the arrangement of the torsional vibration drive for the frame within the housing, which enables optimal lubrication of all moved parts in combination with a comparatively low amount of sealing requirements. An additional factor is that the rotating forward feed movement during forging of round material is supported by the torsional vibrations of the frame and therefore the tool holders radially guided in the frame, which enables the simplification of the construction of the feeding devices for the workpiece.

Although different drives can be used as torsional vibration drive for the actuator that is rotatably held about the forging axis, an especially simple arrangement of the torsional vibration drive can be achieved when the torsional vibration drive is arranged as an eccentric shaft drive. Such an eccentric shaft drive is advantageously suitable with respect to its spatial requirements for the arrangement within the housing.

For the purpose of setting the lifting position of the forging tools, the tool holders can be equipped in the known manner with a device for the radial adjustment of the tool holding fixture of the tool holders, e.g. with hydraulic actuating devices or wedge gears. An additional possibility is provided by the arrangement of the lifting drives with connecting rods resting on abutments of the housing in that the abutments in the housing which support the connecting rods are mounted in a radially adjustable way with respect to the forging axis, so that the lifting position of the lifting drives formed by the connecting rods will also change as a result of said radial displacement of the abutments for the connecting rods. The lifting position of the forging tools can also be influenced by a change in the angle of the vibrating range of the connecting rods. For this purpose, the eccentric shaft of the eccentric shaft drive can be adjustably mounted.

Usually, all forging tools beat in the same direction. This is not mandatory however. In order to allow forging tools to beat in an alternating fashion for special applications, the connecting rods can extend in an inclined manner with respect to the tool holders in opposite directions in a middle lifting position of the lifting drives for the tool holders that will be used in an alternating fashion. This means that during the pivoting of the connecting rods in one circumferential direction the one set of connecting rods performs a working stroke and the connecting rods inclined in the opposite direction perform a returning stroke.

BRIEF DESCRIPTION OF THE DRAWINGS

The subject matter of the invention is shown by way of example in the drawing, wherein.

DESCRIPTION OF THE PREFERRED EMBODIMENT

Figure 1:
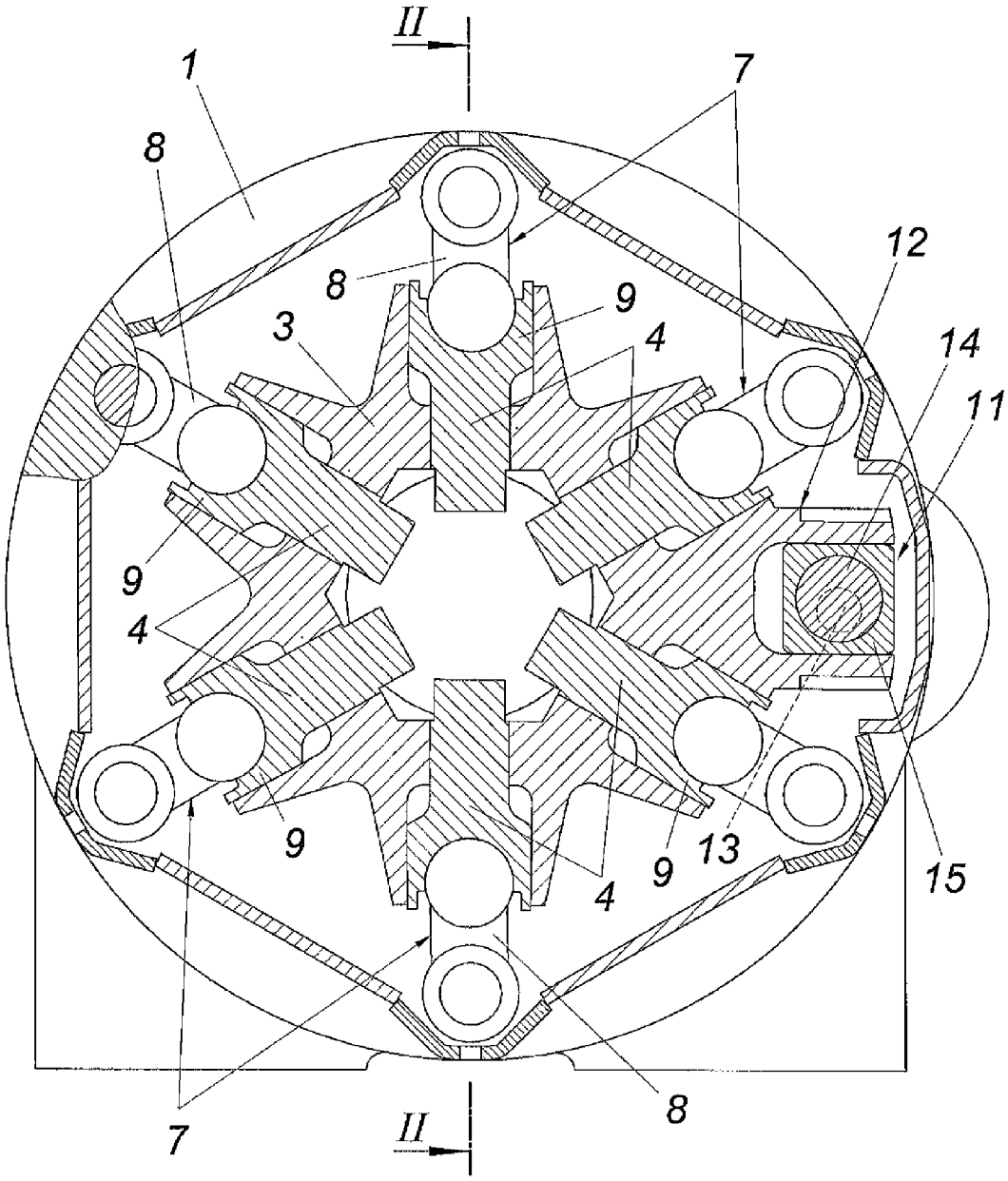
FIG. 1 shows a schematic, simplified axially normal sectional view of a forging apparatus in accordance with the invention.
Figure 2:
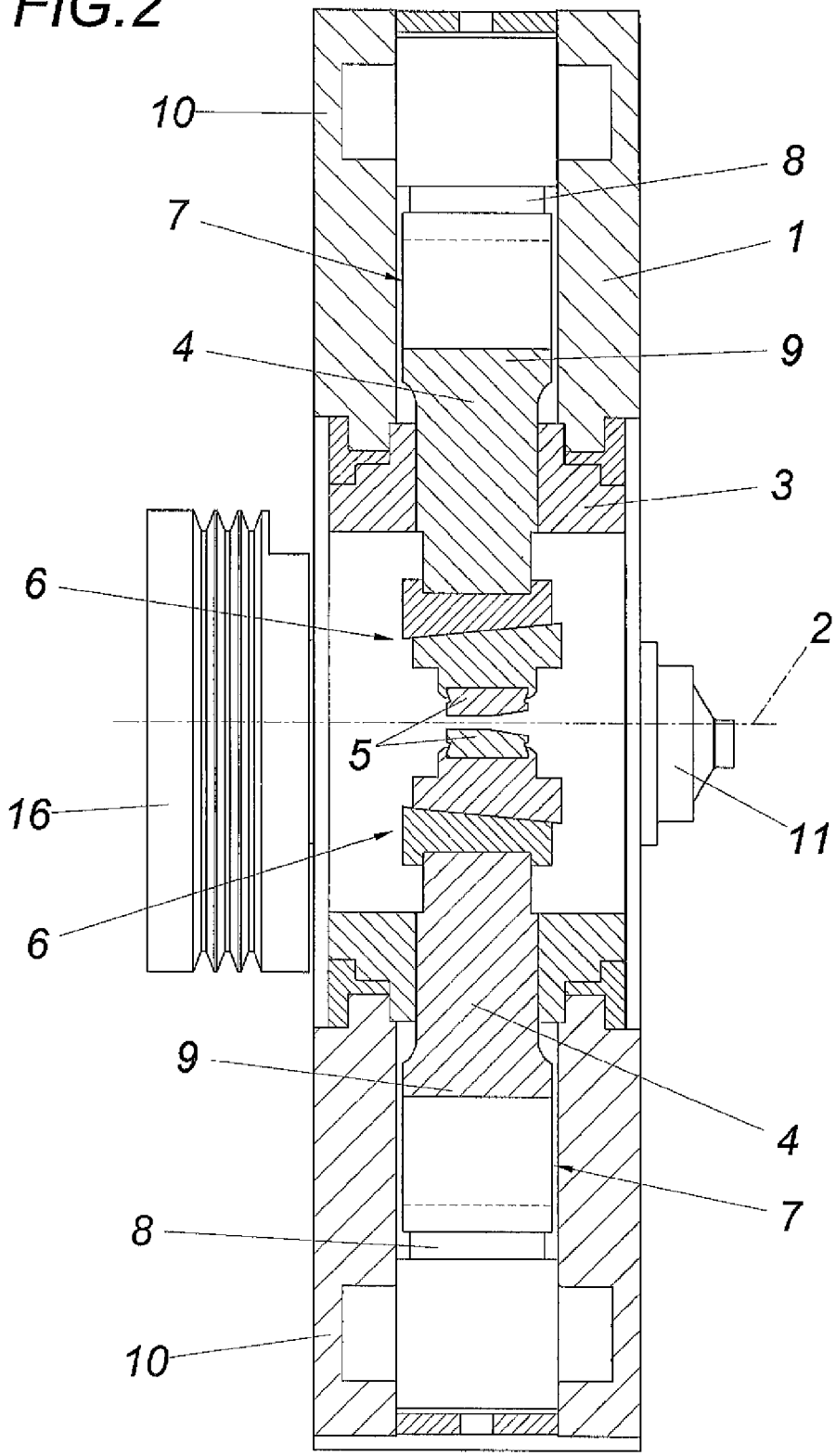
FIG. 2 shows this forging apparatus in a sectional view along the line II-II of FIG. 1 on an enlarged scale.

As is shown in FIGS. 1 and 2, the forging apparatus comprises a housing 1 and a frame 3 which is rotatably mounted about a forging axis 2 in the housing 1 and which accommodates tool holders 4 which are radially guided with respect to the forging axis 2. Said tool holders 4 are equipped with forging tools 5 according to FIG. 2, which are connected via wedge gears 6 for setting the lifting position of the forging tools 5 on the tool holders 4. Lifting drives 7 are associated with the tool holders 4 for activating the forging tools 5, which lifting drives respectively comprise a connecting rod 8 which pivotably rests via abutments 9, 10 on the associated tool holder 4 on the one hand and on the housing 1 on the other hand. If the frame 3 is rotated with respect to the fixed housing 1, the abutments 9 are also rotated in relation to the abutments 10 of the connecting rods 8 with respect to the forging axis 2 with the consequence that the tool holders 4 in the frame 3 are radially displaced. Since a torsional vibration drive 11 is provided between the housing 1 and the frame 3, the frame 3 is driven in a torsionally vibrating manner as the actuator 12 for the lifting drives 7, so that the tool holders 4 are subjected to working and returning strokes. An eccentric shaft drive with an eccentric shaft 13 is provided in the embodiment as a torsional vibration drive 11, the eccentric 14 of which acts by way of a sliding block 15 on the actuator 12. A belt pulley 16 is provided in FIG. 2 for driving the eccentric shaft 13.

Figure 3:
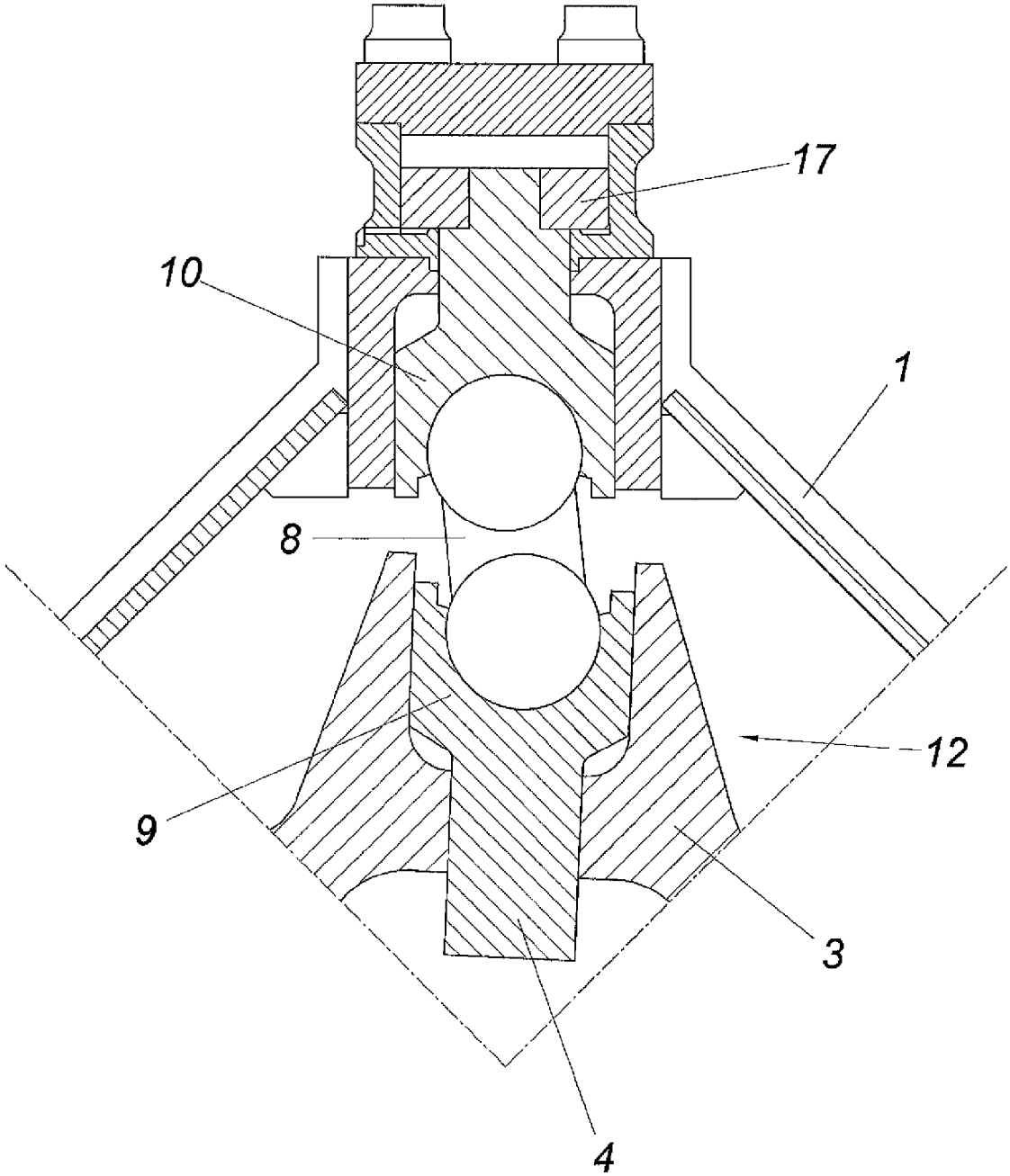
FIG. 3 shows an embodiment of a lifting drive for a tool holder in a sectional view perpendicularly to the forging axis on an enlarged scale.

According to FIG. 3, the abutments 10 belonging to the housing 1 can be radially adjusted with respect to the forging axis 2, which occurs by way of one respective hydraulically actuated piston 17, which is not mandatory however because a mechanical displacement of the abutments 10 also solves the task of setting the lifting position of the tool holders 4 and therefore the forging tools 5.

Figure 4:
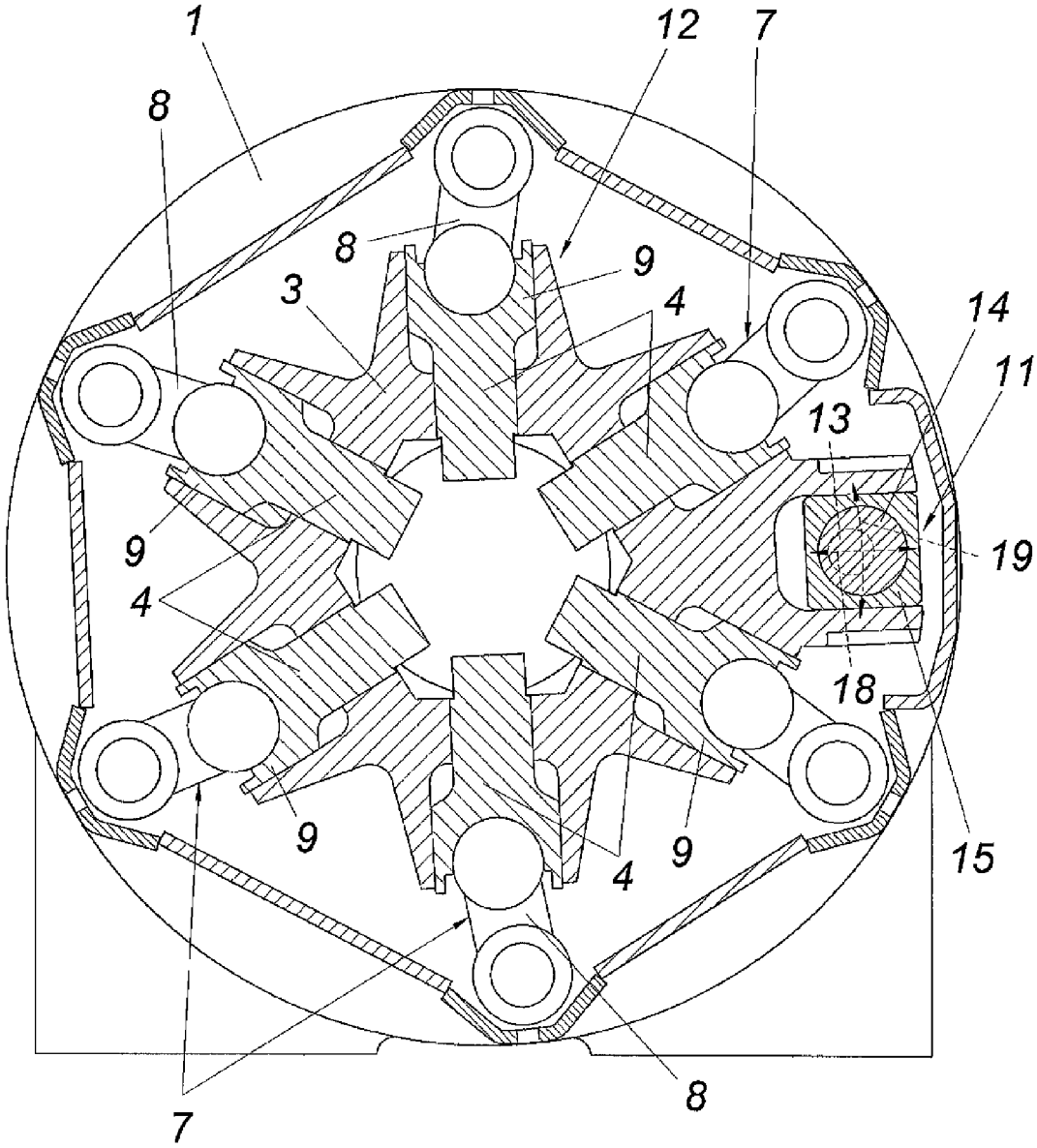
FIG. 4 shows an illustration corresponding to FIG. 1 of a constructional variant of a forging apparatus in accordance with the invention.

As is shown in FIG. 4, tool holders 4 can also be used in an alternating fashion, if so required. For this purpose, the connecting rod 8 can be inclined in an alternating fashion in opposite directions in a middle lifting position of the tool holders 4, so that during a rotational movement of the frame 3 in one direction every other tool holders 4 performs a working stroke and the tool holders 4 which are disposed in between perform a return stroke in order to move the tool holders 4 in the opposite direction during the rotational movement of the frame 3 in the opposite direction, and process the workpiece in an alternating fashion with the provided forging tools, which always occurs in a rotationally symmetrical way.

It is understood that the invention is not limited to the illustrated embodiments. The eccentric shaft 13 of the eccentric shaft drive could also be displaced for setting the lifting position or the stroke. The vibrating width of the connecting rod 8 is influenced by a radial displacement of the eccentric shaft 13 with respect to the forging axis 2, which is indicated by an arrow 18 in FIG. 4. When the eccentric shaft 13 is displaced in the direction of the torsional vibrations of the actuator 12 (i.e. in the direction of arrow 19), the middle position of the connecting rods 8 and therefore the lifted position of the tool holders 4 will be changed.

The invention claimed is:

1. A forging apparatus comprising (a) a housing;

(b) a plurality of first abutments provided on the housing;

(c) a forging axis;

(d) a frame rotatably mounted about the forging axis;

(e) a plurality of tool holders radially guided in the frame;

(f) a plurality of second abutments provided on the tool holders;

(g) a plurality of lifting drives connected with the tool holders, each lifting drive comprising a respective connecting rod pivotally supported by the first abutments and by a respective second abutment of the plurality of second abutments;

(h) a plurality of forging tools provided in the tool holders and arranged symmetrically around the forging axis;

(i) a common drive for the lifting drives comprising a torsional vibration drive provided between the housing and the frame, said torsional vibration drive comprising an eccentric shaft drive, said eccentric shaft drive comprising a radially adjustable eccentric shaft; and (j) a belt pulley for driving the eccentric shaft around an axis of the eccentric shaft;

wherein the frame comprises at least one abutment actuator driven by the torsional vibration drive for the first abutments or the second abutments and at least one lifting drive actuator for the common drive for the lifting drives.

2. The forging apparatus according to claim 1, further comprising a hydraulically actuated piston for radially adjusting the first abutments with respect to the forging axis.

3. The forging apparatus according to claim 1, wherein the tool holders are moveable into a middle lifting position via the lifting drives and the connecting rods extend in an inclined manner in opposite directions with respect to the tool holders in the middle lifting position.

* * * * *